US005456420A

United States Patent [19]

Frazier

[11] Patent Number: 5,456,420

[45] Date of Patent: Oct. 10, 1995

[54] ROLLED TISSUE DISPENSER

[75] Inventor: Alan D. Frazier, West Chester, Pa.

[73] Assignee: Scott Paper Company, Philadelphia, Pa.

[21] Appl. No.: 186,835

[22] Filed: Jan. 25, 1994

Related U.S. Application Data

[63] Continuation of Ser. No. 922,445, Jul. 30, 1992, abandoned.

[51] Int. Cl.[6] ..... B65H 19/10

[52] U.S. Cl. ..... 242/564.1; 242/597.7

[58] Field of Search ..... 242/55.53, 55.2, 242/84.8, 564, 564.1, 564.2, 597.8; 312/34.8, 319.1; 225/16, 47

[56] References Cited

U.S. PATENT DOCUMENTS

| | | | |
|---|---|---|---|
| 2,565,994 | 8/1951 | Sevenich | 242/564 |
| 2,923,968 | 2/1958 | Marcuse et al. | 312/39 |
| 3,281,032 | 10/1966 | Solomon . | |
| 3,058,390 | 10/1962 | Treiss | 88/28 |
| 3,317,099 | 5/1967 | Solomon | 225/23 |
| 3,317,150 | 5/1967 | Summersby | 242/564 |
| 3,986,677 | 10/1976 | Ootaki et al. | 242/55.53 |
| 4,179,078 | 12/1979 | Mansfield | 242/55.53 |
| 4,372,500 | 2/1983 | Saraisky . | |
| 4,738,385 | 4/1988 | Bell | 242/55.54 |
| 4,741,439 | 5/1988 | Bizic | 206/316 |

FOREIGN PATENT DOCUMENTS

| | | | |
|---|---|---|---|
| 731449 | 6/1955 | United Kingdom | 242/55.2 |

*Primary Examiner*—Daniel P. Stodola
*Assistant Examiner*—Eileen A. Dunn
*Attorney, Agent, or Firm*—Woodcock, Washburn, Kurtz, MacKiewicz & Norris

[57] ABSTRACT

A tissue dispenser for dispensing rolls of sanitary tissue wound on a core having a main housing having a rear wall which is adapted to be mounted to a vertical surface. A spindle projects into the main housing substantially perpendicularly from the rear wall to support a roll of tissue within the main housing. A door is pivotally mounted to the front of the main housing such that the roll of tissue can be substantially enclosed therein with an exit port at the base of the dispenser through which the tissue is dispensed. The door includes a knob housing in which a rotatable knob resides. The rotatable knob is spring biased such that it normally resides in a position away from the roll of tissue. Extending from the knob are teeth or cogs. When the tail of tissue is not presented through the exit port of the dispenser, a user can retrieve the tail by depressing the knob against the biasing of the spring such that the teeth or cogs engage the roll of tissue and/or the spindle. By rotating the knob in a depressed position, the roll of tissue also rotated causing tissue to unwind from the roll and descend through the exit port.

14 Claims, 5 Drawing Sheets

ROLLED TISSUE DISPENSER

BACKGROUND OF THE INVENTION

1. Field of the Invention

This invention relates generally to rolled tissue dispensing apparatus and, more particularly, to apparatus to accessing lost tails of rolled tissue product from within rolled tissue dispensers.

2. Brief Description of the Prior Art

There are a variety of tissue dispensers known in the prior art. Some of such dispensers mount to a wall with the spindle which supports the roll of tissue parallel to the wall on which the dispenser is mounted whereas others mount such that the spindle is perpendicular to the wall on which the dispenser is mounted. Many of such dispensers which are designed for commercial use are substantially completely enclosed such that the tail is accessed through an opening in the bottom of the dispenser. A common problem with such an enclosed-type dispenser is that if the tissue breaks prematurely, there is no tail presented to the user to further access the roll. The user typically must reach beneath the dispenser and up through the dispensing port to begin blindly rotating the roll in hopes of finding the tail.

There are similar problems encountered with no-touch rolled paper towel dispensers. In such no-touch rolled towel dispensers, the user grasps the tail and pulls. Typically, such dispensers are provided with a hand wheel to overcome the loss of tail problem. Such hand wheel can be used to manually drive the drum across which the paper is taken within the dispenser to thereby provide access to the user. Such hand wheel is always engaged and continually provides a drag force which must be overcome when extracting the paper from the dispenser.

U.S. Pat. No. 3,317,099 to Solomon, teaches a dispenser for rolled products which includes a hand wheel. In the Solomon dispenser, the hand wheel is connected directly to the support spindle on which the rolled product is mounted such that by rotating the hand wheel, the rolled product is also rotated.

U.S. Pat. No. 4,738,385 to Bell, teaches a dispensing apparatus for dispensing rolled products such as paper towels. The dispenser is adapted to be placed on a horizontal surface such that the axis of rotation of the rolled product is perpendicular to the horizontal surface on which the dispenser rests. A gripping means is provided at the top of the dispenser. Such gripping means is spring loaded such that it is normally not engaged with the edge of the rolled product. The user grasps the tail extending from a vertical slot in the dispenser and, once having extracted the desired length, presses down on the gripping means to prevent further rotation of the rolled towel product such that the tail can be torn off for use.

U.S. Pat. No. 3,986,677 to Ootaki, et al., teaches a toilet paper dispenser which contains two rolls of toilet tissue. When the toilet paper on the first roll is exhausted, a handle is pushed which automatically ejects the spent toilet roll shaft and simultaneously mounts the replacement roll for use.

SUMMARY OF THE INVENTION

It is an object of the present invention to provide a rolled tissue dispenser which includes means for easily accessing a lost tail within the dispenser.

It is a further object of the present invention to provide an enclosed tissue dispenser which includes means mounted externally to the enclosed dispenser which allows rotation of the rolled tissue product.

It is yet another object of the present invention to provide manually actuatable means for rotating the roll of tissue product when a tail is lost, wherein the manually actuatable means is normally disengaged from the rolled tissue product such that it places no drag on such tissue product as it is normally extracted from the dispenser.

Briefly stated the foregoing and numerous other objects, features and advantages of the present invention will become readily apparent upon a reading of the detailed description, claims and drawings set forth herein. These objects, features and advantages are accomplished by providing an enclosed tissue dispenser with a rotatable knob accessible externally of the cabinet of the dispenser. The rotatable knob includes a geared or toothed surface for engagement with either the roll of tissue or the spindle which supports the roll of tissue. The knob is spring biased such that the teeth of the knob are normally disengaged from the roll of tissue and the spindle. In such manner, during normal operation, as tissue is being extracted from the dispenser, the knob does not rotate and, therefore, places no frictional drag on the rolled tissue product. Further, because when the knob is in its normally disengaged position, the toothed surface resides in a recessed position in a knob housing, there is no chance that the knob or hub will bind in any way which would surely cause the tissue product to break prematurely.

DETAILED DESCRIPTION OF THE PREFERRED EMBODIMENT

Figure 1:
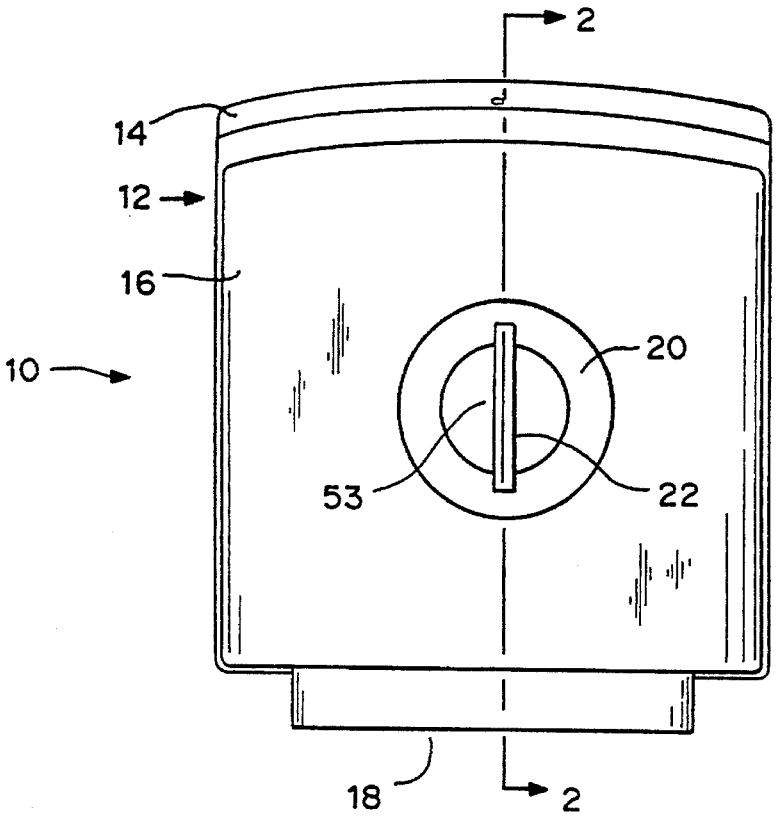
FIG. 1 is a front elevational view of the preferred embodiment of the present invention.

Turning first to FIG. 1 and there is shown the rolled tissue dispenser 10 of the present invention. The dispenser 10 comprises the cabinet 12 which includes a rear or main housing 14 and a pivotally mounted door or front housing 16. At the base of the dispenser 10 there is an access port 18 (See FIG. 5) through which the tissue is withdrawn from dispenser 10. Mounted in front housing or door 16 is rotatable hub or knob 20 which includes bar member 22 extending therefrom adapted to be easily grasped by a user.

Figure 2:
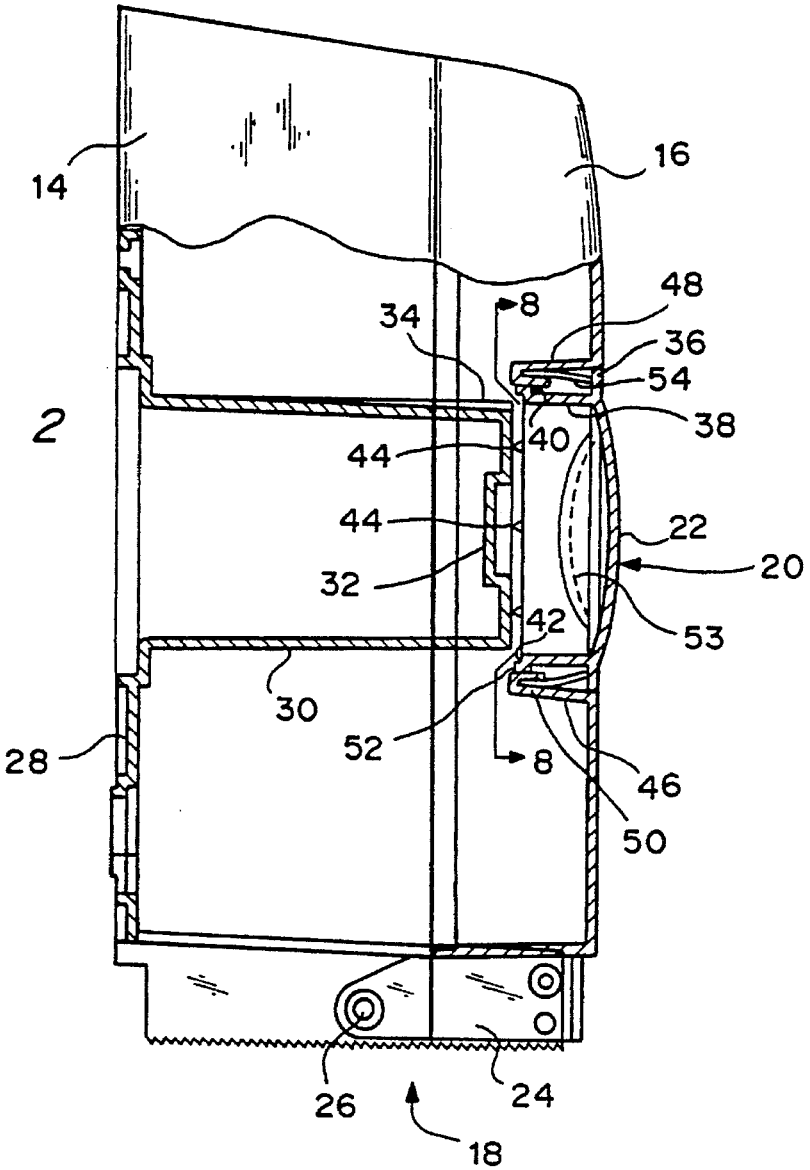
FIG. 2 is a partial side sectional view taken along line 2—2 of FIG. 1.
Figure 3:
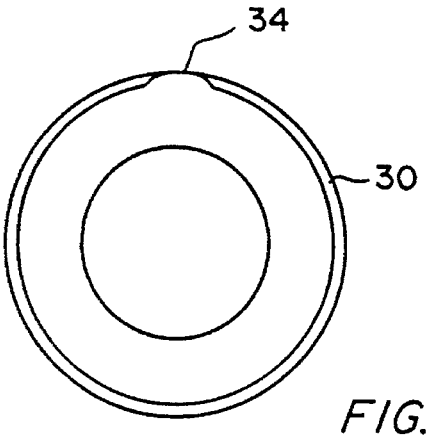
FIG. 3 is an end view of the spindle.
Figure 4:
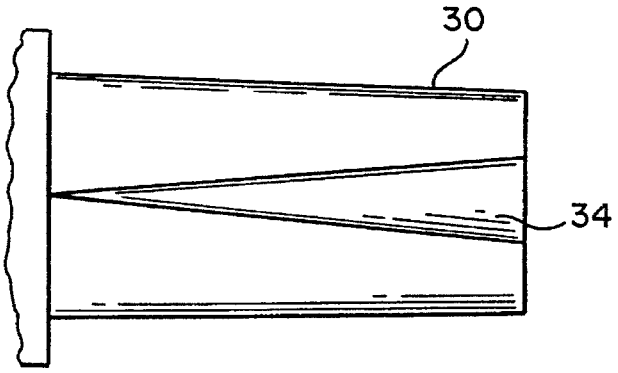
FIG. 4 is a top view of the spindle.

Looking next at FIG. 2, it can be seen that front housing or door 16 is pivotally mounted to rear housing 14 by means of hinges 24 which pivot about pins 26. Hinges 24 allow door 16 to be opened to service the dispenser 10. There is a key way 27 at the top of dispenser 10 (see FIG. 1) which allowed access to a latching/locking mechansim (not shown) to maintain door 16 in a normally closed position. Extending from the back wall 28 of rear housing 14 is spindle or roll support 30 which is substantially cylindrical although slightly tapered toward its distal end 32 to facilitate ease of mounting a roll of tissue thereon. The diameter of spindle 30 is smaller than the inside diameter of the core of tissue to be supported thereon such that the roll of tissue may rotate freely. The spindle 30 includes a tapered arcuate support surface 34. (See FIGS. 3 and 4) It is on tapering support surface 34 that the core of the roll of tissue actually rests. The tapered support surface 34 supports the roll of tissue such that it is substantially perpendicular to the plane of the rear wall 28. In such manner, the tapering of spindle 30 does not cause the roll of tissue to be tilted within dispenser 10 such that it would be caused to slide toward the front of dispenser 10 and bind.

Hub 20 includes a radially extending lip or ring member 36 and a cylindrical portion 38 which extends substantially perpendicularly from a lip or ring member 36. At the end of cylindrical portion 38 away from lip or ring member 36 there is a radially extending ledge 40 which further provides cylindrical section 38 with a widened annular base 42. Extending from annular base 42 are a plurality of teeth 44.

Figure 8:
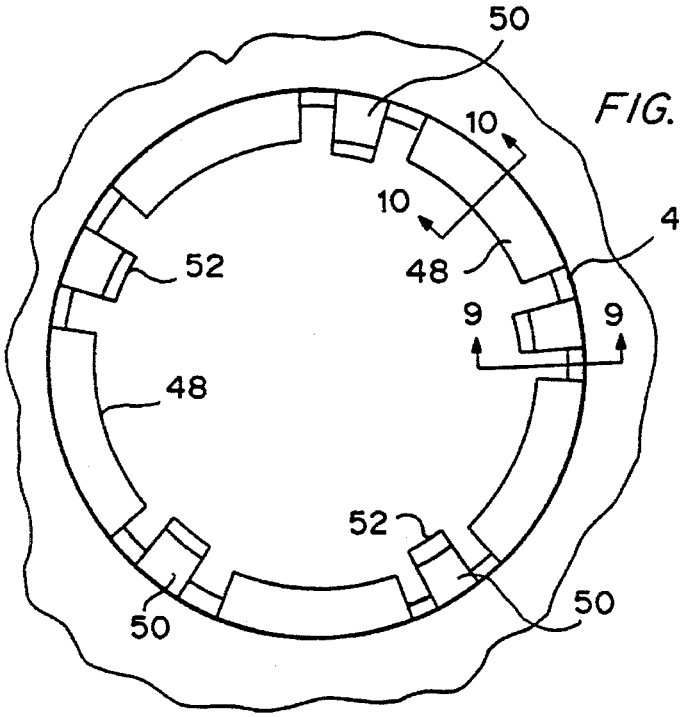
FIG. 8 is a partial elevational view of the hub housing from within the dispenser along line 8—8 of FIG. 2.
Figure 9:
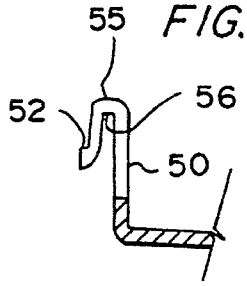
FIG. 9 is a sectional view taken along lines 9—9 of FIG. 8.
Figure 10:
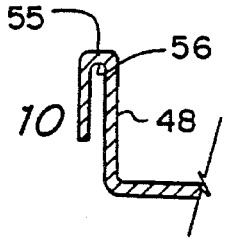
FIG. 10 is a sectional view taken along lines 10—10 of FIG. 8.
Figure 6:
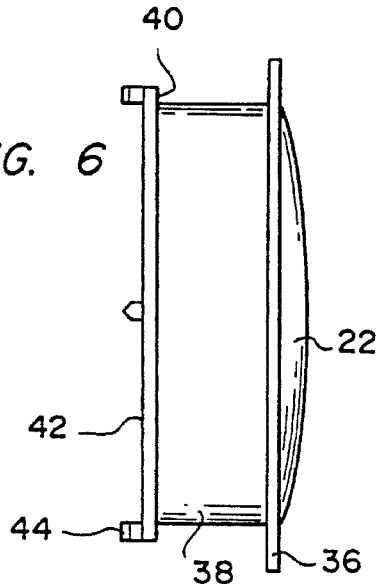
FIG. 6 is a side elevational view of the rotatable hub of the present invention.
Figure 7:
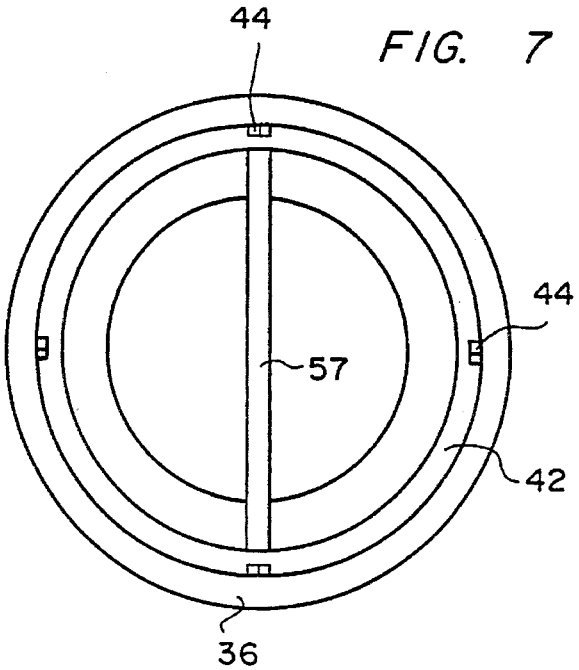
FIG. 7 is a rear elevational view of the rotatable hub of the present invention.

Hub or knob 20 resides within hub housing 46 which is integrally formed with door 16. Hub housing 46 is comprised of plurality of guide fingers 48 and snap-fit fingers 50. (See FIGS. 8, 9 and 10). Guide fingers 48 and the snap-fit fingers 50 are substantially hook-shaped or J-shaped in cross section with snap-fit fingers 50 including a radially inwardly projecting lip 52 which, in combination with ledge 40, serves to retain hub 20 in hub housing 46. Residing within hub housing 46 is spring 54. Spring 54 is compressed such that it presses against the surfaces 56 of fingers 48, 50 and against the inside surface of ring member 36. In such manner, spring 54 biases hub 20 such that ring member 36 is substantially co-planar with the front surface of door 16 and such that annular ledge 40 abuts lips 52. Lips 52 thus serve as an outer travel stop for hub or knob 20. Because edges 55 of fingers 48, 50 form a circular perimeter having a diameter less than the diameter of ring member 36, edges 55 serve as inner travel stops for hub or knob 20.

As noted above, guide fingers 48 and snap-fit fingers 50 are preferably integrally formed with door 16. This is accomplished by injection molding the entire piece using a suitable plastic. In that way, fingers 48, 50 will have some limited flexibility allowing hub 20 (also preferably an injection molded plastic part) to be snap-fit into hub housing 46. Hub 20 preferably includes a depressed circular region 53 which allows easier access to bar member 22. Because the hub 20 is injection molded a corresponding slot 57 is formed beneath bar member 22.

In operation, with a roll of tissue supported on spindle 30, if the tail of tissue is not visibly extending through exit port 18, the user need merely depress hub 20 overcoming the bias of spring 54 causing teeth 44 to engage the roll of tissue at the core of the tissue or in very close proximity thereto. While maintaining the hub 20 in a depressed position, the user can then use bar 22 to turn the hub and thereby impart a rotation to the roll of tissue which will eventually cause a tail of tissue to be presented through exit port 18. When the tail of the tissue is presented, the user can release hub 20 and spring 54 causes it to disengage from the roll of tissue. The user then need merely grab the tail presented through exit port 18 to extract tissue from the dispenser 10. Because hub 20 is now in a retracted position with the apexes of teeth 44 residing completely within hub housing 46, there is no chance that teeth 44 will engage the roll of tissue even should the roll of tissue move laterally on spindle 30. In such manner, no drag is placed on the roll of tissue by the hub 20 which could cause premature breaking of the tissue and/or further loss of tail as it is being withdrawn from the dispenser.

Figure 5:
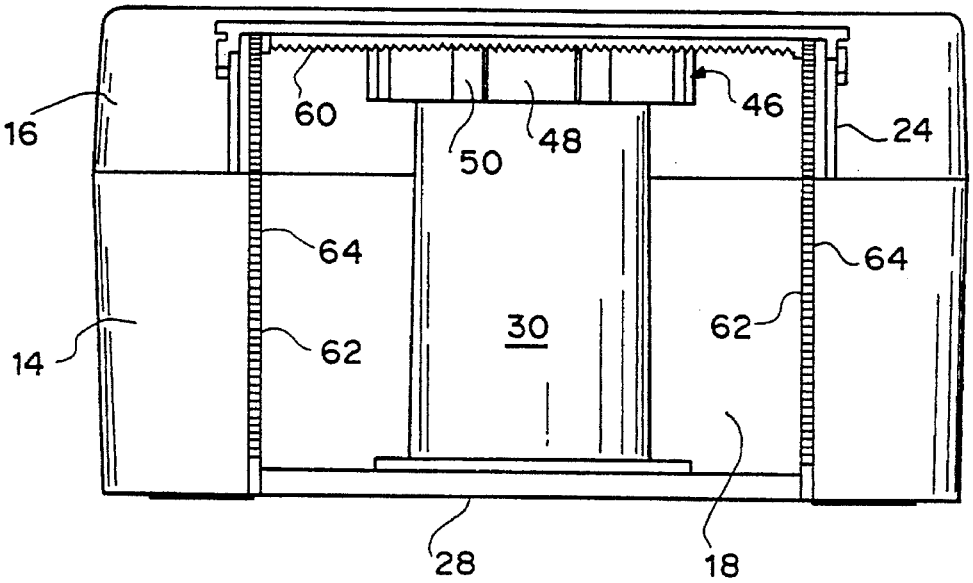
FIG. 5 is a bottom plan view of the preferred embodiment of the dispenser of the present invention.

As depicted in FIG. 5, exit port 18 is a substantially rectangular opening. At the front of exit port 18 located below hub housing 46 is a row of horizontally projecting serrations 60. At each of the side edges 62 of exit port 18 there is a row of downwardly projecting serrations 64. The rows of serrations 60, 64 facilitate the tearing of the roll of tissue by a user when such user has withdrawn the desired length from the dispenser 10.

Figure 11:
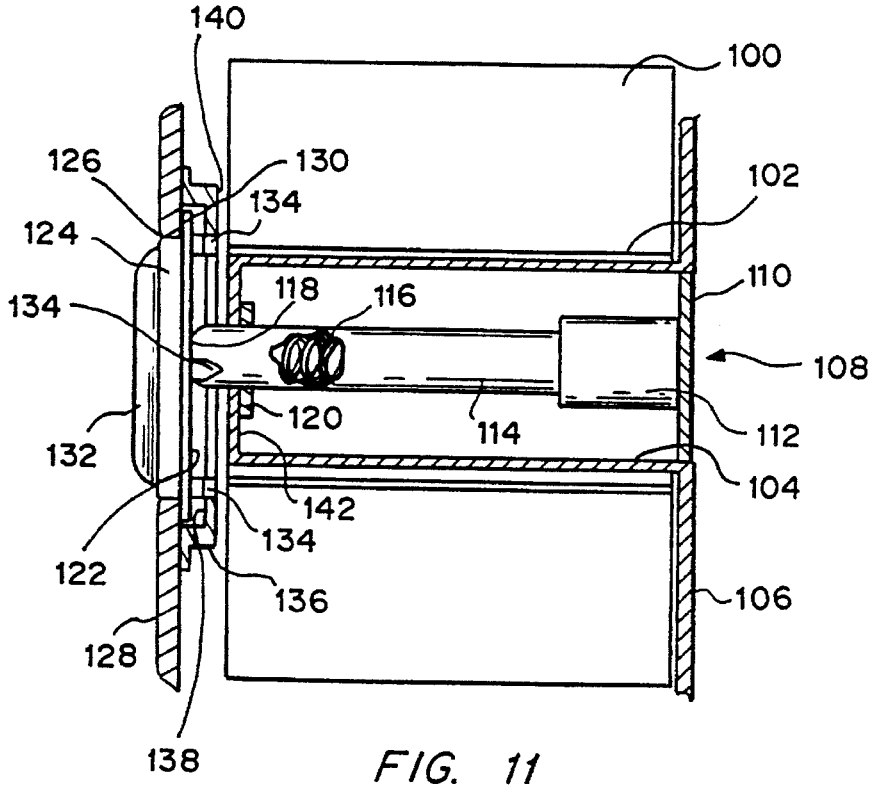
FIG 11 is a partial sectional view of an alternative embodiment of the knob and knob biasing means of the present invention with the alternative embodiment knob in its normally disengaged position.
Figure 12:
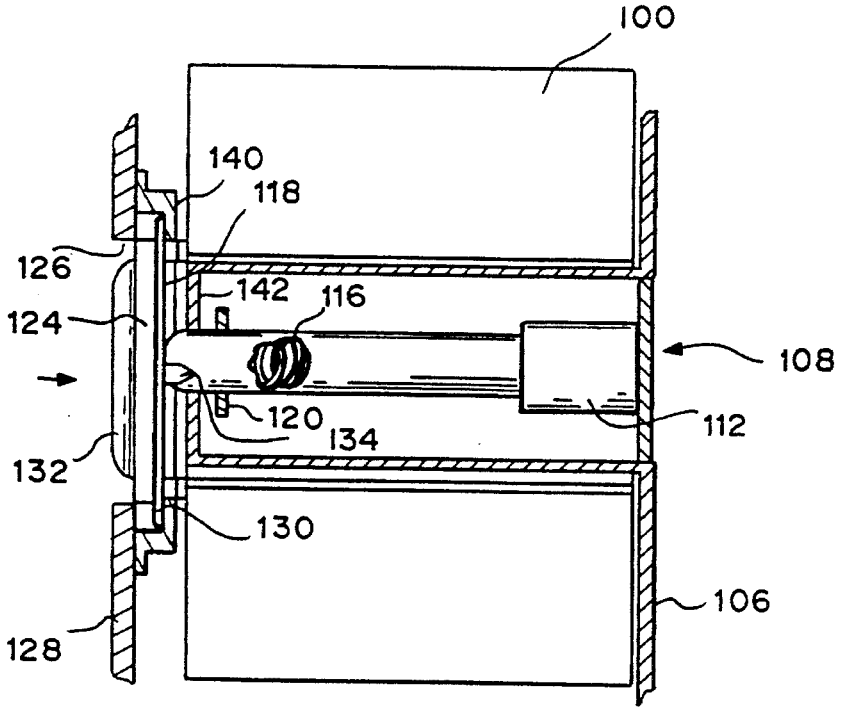
FIG. 12 is a partial sectional view of the alternative embodiment of the knob and knob biasing means depicted in FIG. 11 with the alternative embodiment knob in a depressed position to engage the roll of tissue.

Looking next at FIGS. 11 and 12 there is depicted a partial sectional view of an alternative embodiment of the present invention. A roll of tissue 100 wound on a core 102 is supported on a spindle 104. Spindle 104 is substantially cylindrical and projects from the rear wall 106 of the dispenser. Contained within spindle 104 is hub biasing mechanism 108. Hub biasing mechanism 108 is comprised of a disk or base wall section 110, a fixed cylindrical section 112, and a telescoping cylindrical section 114. Contained within telescoping cylindrical section 114 and extending into fixed cylindrical portion 112 is spring 116. Telescoping cylindrical section 114 includes a closed end 118. Extending substantially radially outward from telescoping cylindrical section 114 and affixed thereto is retaining ring or flange 120. The closed end 118 of telescoping cylindrical section 114 presses against the inside surface 122 of hub or knob 124. Hub or knob 124 extends through a circular port 126 in front housing or door 128. Extending radially from knob 124 is annular ledge or ring member 130. Knob 124 further includes a bar member 132 to promote easier rotation of knob 124 by a user. Extending from annular ledge 130 are a plurality of teeth 134. Affixed to the inside surface of front housing or door 128 is retaining collar 136. Retaining collar 136 provides an annular lip 138 which acts as the inner travel stop for knob 124. In such manner, knob 124 can be caused to move horizontally inward toward the roll of tissue 100 to the extent that ring 130 abuts annular lip 138. The inside surface of door 128 acts as an outer travel stop for knob 124. Retaining collar 136, along with that portion of the door 128 to which retaining collar 136 is affixed, serves as a housing for hub or knob 124.

Spring 116 biases telescoping member 114 such that the closed end 118 presses against the inside surface 122 of knob 124 maintaining ring 130 in a position abutting the inside surface of door 128. In such manner, the teeth 134 reside in a retracted position such that they do not project past surface 140 of retaining collar 136. Spindle 104 includes a closed end 142 having a bore therethrough, through which telescoping section 114 extends. In the normally biased position, retaining flange 120 is pressed against closed end 142 thus serving as a travel stop for telescoping portion 114 and preventing telescoping section 114 from ejecting from fixed cylindrical portion 112 when door 128 is opened.

As shown in FIG. 11, when the tail is not presented for access by a user, the user need merely depress hub 124 and rotate it through the use of bar 132. Teeth 134 engage the core 102 and/or the roll of tissue 100 in close proximity to the core to thereby rotate the roll of tissue to cause a tail to be presented at the exit port. When the tail is so presented, the user need merely release hub portion 124 allowing telescoping portion 114 and spring 116 to drive hub portion 124 to its normal position which is non-engaging with the roll of tissue 100.

Figure 13:
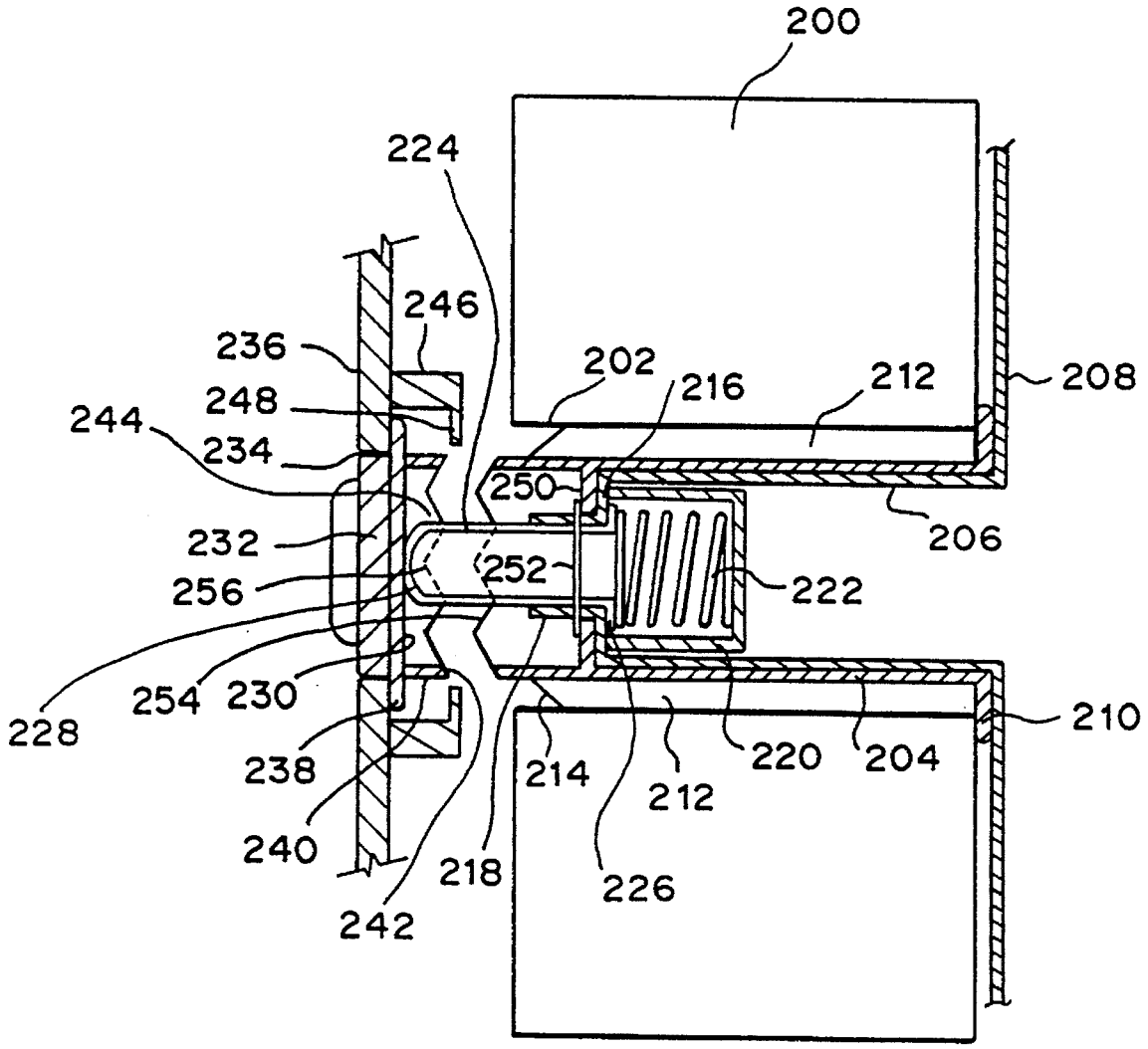
FIG. 13 is a partial sectional view of an alternative embodiment of the knob, knob biasing means and spindle of embodiment shown in FIGS. 1–10 and the embodiment shown in FIGS. 11 and 12.

Looking next at FIG. 13, there is shown another alternative embodiment of the present invention. In such embodiment, a roll of tissue 200 wound around a core 202 is supported on a rotatable spindle 204. The rotatable spindle 204, which cylindrical, fits over fixed cylindrical spindle 206 which projects substantially perpendicularly from rear wall 208. Rotatable spindle 204 includes an annular lip 210 having an outside diameter which is greater than the diameter of the core 202. Projecting radially outward from rotatable spindle 204 are a plurality of flexible fin members 212. Each fin member 212 is substantially a flat planner member having a lead edge 214 which is angled to promote easier insertion of the roll of tissue on to the rotatable spindle 204. The fin members 212 serve to center the roll of tissue 200 on rotatable spindle 204 such that their respective axes of rotation are substantially colinear. Further, fins 212 frictionally engage core 202 such that they will rotate in unison.

Fixed spindle 206 includes a radially inwardly extending lip 216 with a cylindrical collar 218 projecting therefrom which is substantially coaxial with fixed spindle 206. Residing within fixed spindle 206 is spring housing or support member 220. Which houses spring 222 and maintains spring 222 in a somewhat compressed state. Extending through cylindrical collar 218 is the plunger 224. Plunger 224 has an annular lip 226 which is pressed against annular shelf 216 by means of spring 222 thereby acting as a travel stop for plunger 224. The opposite end 228 of plunger 224 is closed and presses against the inside surface 230 of hub or operating knob 232. Hub or operating knob 232 extends through a circular whole 234 in front housing or door 236. There is an annular projection or ring member 238 extending from hub or operating knob 232. Further, extending from the inside surface 230 of hub 232 is a cylindrical member 240 having an inwardly projecting edge 242. Inwardly projecting edge 242 has cut therein a plurality of V-shaped teeth 244.

Affixed to the inside surface of front housing or door 236 is retaining collar 246 which includes a radially inwardly projecting ledge 248 which acts as an inner travel stop for ring member 238. The inside surface of door 236 acts as an outer travel stop.

Extending radially inward within rotating spindle 204 is flange 250. A C-clip 252 is provided about collar 218 in abutting position with flange 250 to retain rotatable spindle 204 on fixed spindle 206 while allowing rotatable spindle 204 to rotate freely thereon. Preferably, there is an annular groove in collar 218 to provide residence for C-clip 252. The distal end 254 of rotatable spindle 204 includes a plurality of V-shaped teeth or cogs 256 cut therein which mesh with teeth 244 when hub or knob 232 is depressed by a user against the biasing of spring 222. In that way, the user, when having no tail presented, can depress the access knob 232 such that teeth 244 engage and mesh with teeth 256. Then, by rotating access knob 232, the roll 200 is rotated to cause a tail to be presented at the access port.

It will be understood by those skilled in the art that although FIG. 11, 12 and 13 depict only partial sectional views of alternative embodiments of the invention depicted in FIGS. 1 through 10, those portions of the dispenser not depicted in FIGS. 11, 12 and 13 would be substantially identical to the dispenser depicted in FIGS. 1, 2 and 5.

Each of the three embodiments described above, included teeth or cogs which engage the core of a roll of tissue or a rotating spindle upon which the roll of tissue is supported. Although teeth or cogs are preferred, other means of frictional engagement between the hub or access knob and the roll of tissue or spindle can be used. For example, the hub could be provided with a ring of a compressible elastomer such as neoprene which would press against the roll of tissue and the core thereof when the access knob is depressed. It would also be possible to provide the hub portion with a roughened surface for frictional engagement such as sandpaper which would frictionally engage the roll of tissue.

From the foregoing, it will be seen that this invention is one well adapted to attain all of the ends and advantages herein above set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matters herein set forth or shown in the accompanying drawings is to be interpreted as illustrative and not in a limiting sense.

What is claimed is:

1. A rolled tissue dispensing apparatus for dispensing tissue wound onto cores to define rolls of tissue, said apparatus comprising:

(a) a main housing including a rear wall that is adapted to be mounted on a vertical surface;

(b) spindle means within said main housing for supporting a roll of tissue, said spindle means extending substantially perpendicularly from said rear wall;

(c) a door pivotally connected to said main housing, said door and said main housing substantially enclosing the roll of tissue therebetween, said door having a knob housing extending therefrom into said main housing; and (d) an exit port located at a base of said main housing through which the roll of tissue is unwound from the core and is dispensed;

(e) a knob that is mounted for rotation within said knob housing, said knob including a plurality of teeth extending therefrom toward the roll of tissue, said knob normally residing in a first position where said teeth do not contact any portion of the roll of tissue, said knob being movable to a second position within said knob housing, whereby said knob is operative by a user such that when the user moves said to said second position, said teeth engage a portion of the roll of tissue in the vicinity of the core and whereupon, by turning said knob while said knob is in said second position, the user will cause the roll of tissue to rotate; and (f) biasing means for normally maintaining said knob in said first position within said knob housing.

2. A rolled tissue dispensing apparatus for dispensing tissue wound onto cores to define rolls of tissue, said apparatus comprising;

(a) a main housing including a rear wall adapted to be mounted on a vertical surface;

(b) spindle means within said main housing for supporting a roll of tissue, said spindle means extending substantially perpendicularly from said rear wall;

(c) a door pivotally connected to said main housing, said door and said main housing substantially enclosing the roll of tissue therebetween, said door having a knob housing extending therefrom into said main housing;

(d) an exit port located at a base of said housing through which the roll of tissue is unwound from the core and is dispensed;

(e ) a knob that is mounted for rotation within said knob housing, said knob including means extending therefrom toward the roll of tissue for engaging the roll of tissue, said knob also being moveable laterally within said knob housing, said knob normally residing in a retracted position where said means for engaging do not contact the roll of tissue, said knob being movable to a depressed position in said knob housing where said means for engaging engages the roll of tissue; and (f) biasing means for normally maintaining said knob in said retracted position within said knob housing so that said means for engaging are normal not in contact said roll of tissue.

3. A rolled tissue dispensing apparatus for dispensing tissue wound onto cores to define rolls of tissue, said apparatus comprising;

(a) a main housing including a rear wall that is adapted to be mounted on a vertical surface;

(b) a rotatable spindle means within said main housing for the supporting a roll of tissue, said spindle means extending substantially perpendicularly from said rear wall;

(c) a door connected to said main housing, said door and said main housing substantially enclosing the roll of tissue therebetween;

(d) an exit port in said main housing through which the roll of tissue is unwound from the core and is dispensed;

(e) means rotatably attached to said door for engaging said rotatable spindle means, said means for engaging also being movable laterally from a normally retracted position to an engaged position; and (f) biasing means for maintaining said means for engaging normally retracted position so that said means for engaging does not contact said rotatable spindle means, said biasing means capable of being overcome by user to laterally move said means for engaging to said engaged position in contact with said rotatable spindle means, thereby allowing the user to rotate said rotatable spindle means and the roll of tissue supported thereon by rotating said means for engaging when said means for engaging is in said engaged position.

4. A rolled tissue dispensing apparatus for dispensing tissue wound onto cores to define rolls of tissue, said apparatus comprising:

(a) a main housing including a rear wall adapted to be mounted on a vertical surface;

(b) spindle means within said main housing for rotatably supporting a roll of tissue, said spindle means extending substantially perpendicularly from said rear wall;

(c) a door connected to said main housing, said door and said main housing substantially enclosing the roll of tissue therebetween;

(d) an exit port in said main housing through which the roll of tissue is unwound from the core and is dispensed;

(e) means rotatably attached to said door for engaging the roll of tissue, said means for engaging also being movable laterally from a normally retracted position to an engaged position; and (f) biasing means for normally maintaining said means for engaging in said normally retracted position so that said means for engaging does not contact said roll of tissue, said biasing means capable of being overcome by a user to laterally move said means for engaging to said engaged position in contact with the roll of tissue thereby allowing the user to rotate the roll of tissue by rotating said means for engaging when said means for engaging is in said engaged position.

5. A rolled tissue dispensing apparatus as recited in claim 4, wherein:

said means for engaging is a mutually operable knob residing in a knob housing, said manually operable knob having a plurality of teeth extending therefrom for engaging the roll of tissue when said knob is moved to said engaged position.

6. A rolled tissue dispensing apparatus as recited in claim 5, wherein:

said knob housing is substantially cylindrical, the longitudinal axis of said substantially cylindrical knob housing being substantially perpendicular to said rear wall means.

7. A rolled tissue dispensing apparatus as recited in claim 5, wherein:

said knob housing includes an inner travel stop and an outer travel stop which limit the distance said knob can move within said knob housing.

8. A rolled tissue dispensing apparatus as recited in claim 4, wherein:

said biasing means resides within said spindle means.

9. A rolled tissue dispensing apparatus as recited in claim 8, wherein:

said biasing means is a spring.

10. A rolled tissue dispensing apparatus as recited in claim 4, wherein:

said biasing means resides within said knob housing.

11. A rolled tissue dispensing apparatus as recited in claim 10, wherein:

said biasing means is a spring.

12. A rolled tissue dispensing apparatus as recited in claim 4, wherein:

said spindle means rotates with the rotation of the roll of tissue, said spindle means having a distal end which is adapted to engage said engaging means when said engaging means is moved to said engaged position.

13. A rolled tissue dispensing apparatus as recited in claim 12, wherein:

said spindle means has a plurality of fins extending radially therefrom, said fins engaging the inside surface of the core so that the axis of rotation of the roll of tissue is substantially collinear with the axis of rotation of said spindle means.

14. A rolled tissue dispensing apparatus for dispensing rolls of tissue wound on a core, as recited in claim 4, wherein:

said means for engaging comprises a knob having a plurality of teeth extending therefrom, said teeth engaging the core of the roll of tissue when said knob is moved to said engaged position.

* * * * *